United States Patent [19]

Pugliese

[11] 4,228,749

[45] Oct. 21, 1980

[54] NEEDLE POSITIONING ATTACHMENT FOR SEWING MACHINE

[75] Inventor: Antonio Pugliese, Miami, Fla.

[73] Assignee: Industrial Pugliese, Inc., Miami, Fla.

[21] Appl. No.: 898,899

[22] Filed: Apr. 24, 1978

[51] Int. Cl.[3] ..... B65M 63/00; D05B 69/36

[52] U.S. Cl. ..... 112/274

[58] Field of Search ..... 112/271, 274

[56] References Cited

U.S. PATENT DOCUMENTS

| | | | |
|---|---|---|---|
| 1,352,226 | 9/1920 | Schoenky | 112/274 |
| 2,277,475 | 3/1942 | Bilger | 112/274 |
| 2,376,648 | 5/1945 | Anderson | 112/274 |
| 3,077,845 | 2/1963 | Bono | 112/274 |
| 3,126,851 | 3/1964 | Carter | 112/274 |
| 3,439,638 | 4/1969 | Zuk | 112/274 |
| 3,977,339 | 8/1976 | Tice | 112/274 X |

*Primary Examiner*—Ronald Feldbaum

*Attorney, Agent, or Firm*—Clarence A. O'Brien; Harvey B. Jacobson

[57] ABSTRACT

A needle positioning attachment connectable to the main drive shaft of a sewing machine in place of a pulley and handwheel assembly conventionally found on blind stitch and similar machines includes a resilient assembly for accumulating energy from rotation of the main drive shaft of the machine so as to use this accumulated energy for actuation of the needle positioning attachment when the main drive shaft ceases rotation. In this manner, the needle of the sewing machine will be positioned as desired for starting a new sewing operation each time the machine is deactuated.

7 Claims, 7 Drawing Figures

NEEDLE POSITIONING ATTACHMENT FOR SEWING MACHINE

BACKGROUND OF THE INVENTION

1. Field of the Invention

This invention relates generally to a needle positioning attachment for sewing machines, and particularly to a needle positioning attachment which can be mounted on the main drive shaft of any industrial sewing machine, and the like, without major modification of the machine in order to control the position of a needle on the machine when the machine comes to a stop.

2. Description of the Prior Art

A basic difficulty encountered by the conventional industrial blind stitch sewing machine, and the like, is that each time the machine is stopped, the operator must reposition the needle prior to starting a new stitch. Conventionally, this needle repositioning is accomplished by the operator grasping the commonly provided handwheel of the machine and turning the wheel until the needle is in a desired position. This procedure results in a substantial loss of time, with a resulting loss in production.

It has been proposed to provide needle positioning devices on sewing machines in order to eliminate the necessity of carrying out the aforementioned needle positioning step prior to the start of each stitching operation on the machine. U.S. Pat. Nos. 2,277,475, issued Mar. 24, 1942, to S. B. Bilger, and 2,376,648, issued May 22, 1945, to T. A. Anderson, disclose examples of sewing machines provided with needle positioning attachments mounted on the main drive shaft of the machine. In these known constructions, however, the sewing machine must be suitably modified to receive the needle positioning device. U.S. Pat. Nos. 3,077,845, issued Feb. 19, 1963, to L. Bono, and 3,439,638, issued Apr. 22, 1969, to P. Zuk, disclose additional examples of automatic needle positioning devices for use with industrial sewing machines, and the like.

SUMMARY OF THE INVENTION

It is an object of the present invention to provide a needle positioning attachment for a sewing machine which can be added to a conventional machine merely by removing the commonly provided pulley and handwheel of the machine and replacing same with the attachment according to the present invention.

It is another object of the invention to provide a needle positioning attachment according to the present invention which accumulates energy from the main drive shaft of the associated sewing machine, and uses this accumulated energy to position the needle of the machine whenever the machine is shut down.

These and other objects are achieved according to the present invention by providing a needle positioning attachment for a sewing machine, having: a pulley arrangement affixed to the main drive shaft of an associated sewing machine in place of the pulley conventionally provided thereon, with the pulley arrangement being connected to the motor of the machine for rotation thereby; a stationary abutment; and a resilient assembly connected to the pulley arrangement and releasably engageable by the stationary abutment for being releasably connected to the main drive shaft of the machine by rotation of the pulley arrangement.

The resilient assembly preferably includes a cup affixed to the pulley arrangement and forming an end wall thereof, a stem extending substantially parallel to the longitudinal extent of the associated main drive shaft of the machine and arranged disposed within the cup, a bottom wall of the cut being provided with an opening for receiving the stem, and a spiral torsion spring having an inner end and an outer end with the latter being affixed to the cup and the former connected to the stem for winding tight the spring and rotating the stem relative to the shaft. A portion of a housing partially comprising the pulley arrangement is provided with a nut having internal screw threads which threadingly engage with external screw threads provided on the stem for causing the stem to become threadingly engaged with the housing, the latter being affixed to the main drive shaft of the associated sewing machine. As the spring is wound by rotation of the housing around the stem, the stem will be put into rotation itself, causing the external threads of the stem to engage with the internal threads of the housing and fasten the stem to the main drive shaft of the associated machine.

The stem advantageously comprises a longitudinally extending element, which passes substantially through the associated housing, and a sleeve having a hollow, counterboard, spring seat portion partially forming same and affixed on the longitudinally extending element for permitting sliding and rotating movement of the sleeve and the element within the housing. A compression spring is disposed abutting the spring seat portion of the sleeve and a coupler provided with sockets for receiving adjacent ends of both the longitudinal element and the main drive shaft of the machine for biasing the sleeve and element away from the coupler portion and toward the abutment.

The sleeve is provided with a projection which usually engages with a lug provided on the stationary abutment so that the sleeve is restrained against rotation. As the longitudinally extending element of the stem is completely engaged with the coupler and the stem is attached to the main drive shaft of the associated sewing machine by way of the coupler, the projection will be moved axially together with the longitudinal extending element so that the projection of the sleeve will be brought almost totally out of engagement with the stationary lug. A cam arrangement is mounted on the outer surface of the bottom wall of the cup so as to be actuated by centrifugal force generated by rotation of the cup, and the associated housing, so as to depress the sleeve and element against the bias of the coiled spring and cause the projection to become completely disengaged with the lug.

The motor of the sewing machine stops simultaneously with the pulley and housing of the needle positioner. When this occurs, the spiral torsion spring will cause the stem to rotate in the opposite direction so as to disengage the threads thereof from those of the housing, while simultaneously causing the main drive shaft of the associated sewing machine to rotate a preset amount in order to move the needle of the machine to the desired position. Now the attachment and machine are both ready to start a new sewing operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1, 5, 7:
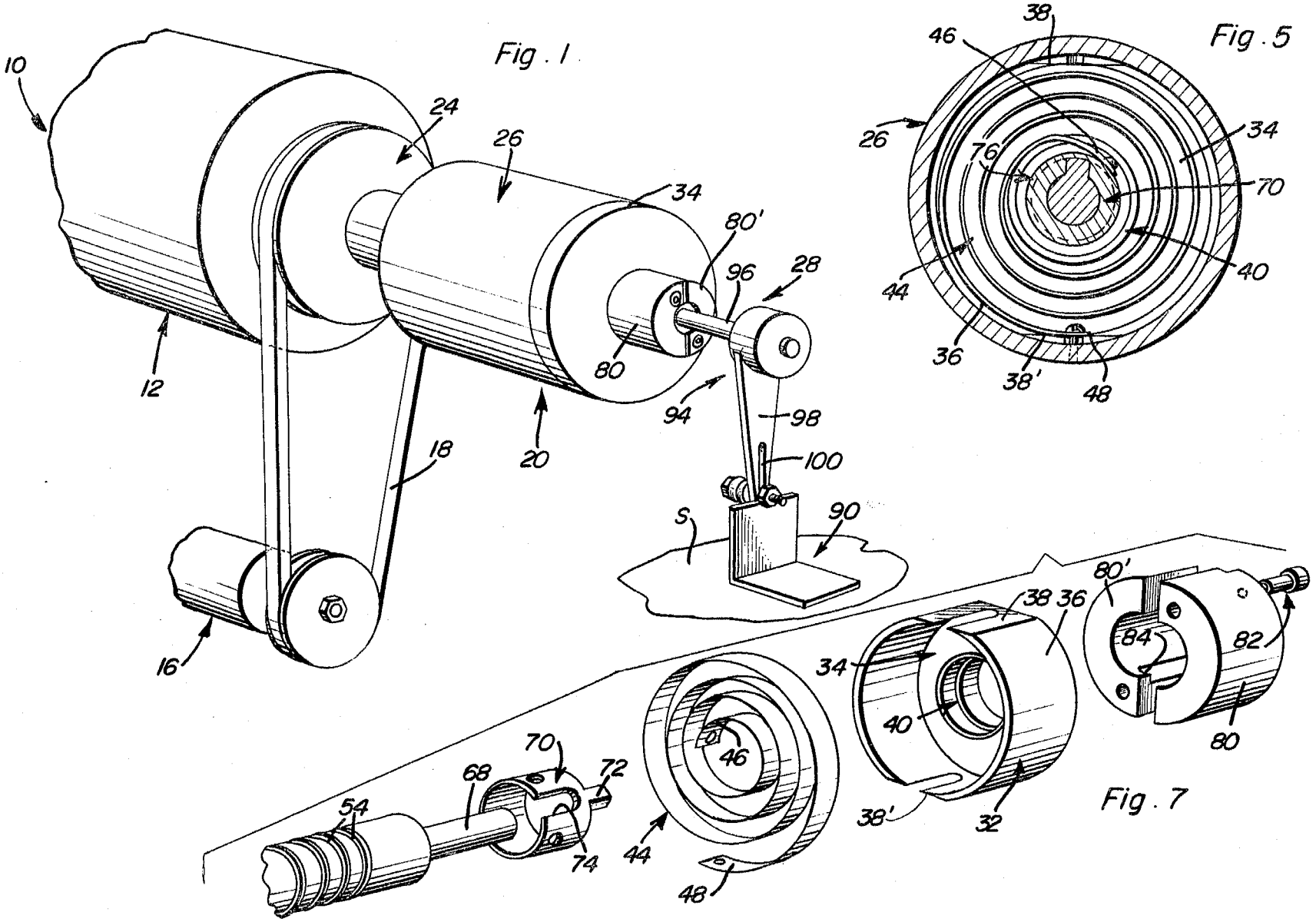
FIG. 1 is a fragmentary, schematic, perspective view showing a needle positioning attachment according to the present invention mounted on a conventional sewing machine.
FIG. 5 is a sectional view taken generally along the line 5—5 of FIG. 2, but some parts removed for clarity
FIG. 7 is a fragmentary, exploded, perspective view, which complements FIG. 6 by showing the remainder of the internal working elements of a needle positioning attachment according to the present invention.

Referring now more particularly to FIG. 1 of the drawings, a sewing machine 10 of conventional construction includes a head 12 through which extends a main drive shaft 14 (FIG. 2) rotated by a motor 16 communicating by means of a belt 18 with a needle positioning attachment 20, according to the present invention, mounted on main drive shaft 14. Since the construction of sewing machine 10 is generally conventional and similar to that shown in, for example, U.S. Pat. No. 3,349,638, issued Apr. 22, 1969, to P. Zuk, machine 10 will not be described in greater detail herein.

Attachment 20 is connected to shaft 14 so as to be arranged for accumulating energy from the rotation of housing 26 for actuation of attachment 20 to position a needle (not shown) when housing 26 ceases rotation. The construction of needle positioning attachment 20, which permits this result will now be described with particular reference to FIGS. 2 through 7 of the drawings.

As can be seen from FIG. 1 of the aforementioned U.S. Pat. No. 3,439,638, the conventional sewing machine includes a handwheel and associated pulley, with the latter being connected to the drive shaft of an electric motor, and the like, similar to motor 16, by means of a suitable belt, similar to belt 18, so that the motor can drive the main drive shaft of the sewing machine. The handwheel is provided for positioning the needle before the start of each sewing operation. To use attachment 20 according to the present invention, this handwheel and associated pulley are first removed in a simple manner from the associated main drive shaft, and attachment 20 is inserted on the drive shaft in their place. More specifically, attachment 20 includes a pulley 24 which receives the drive belt 18 so as to function in the manner of the conventional pulley removed from the drive shaft 14 prior to mounting of attachment 20 thereon. The attachment 20 also includes a housing 26 extending from pulley 24 in the direction away from machine 10, or outboard thereof, toward a stationary abutment 28. Disposed within housing 26 is a resilient assembly 30 releasably engageable by abutment 28 for being releasably connected to shaft 14 and which accumulates energy during a sewing operation being performed by machine 10.

Resilient assembly 30 includes a cup 32 having a planar diskshaped bottom wall 34 which has extending therefrom within the circular periphery thereof a general cylindrical side wall 36. The latter is provided with flat portions 38 and 38′ in which are provided slots for permitting securing of cup 32 to a cylindrical portion of housing 26 as by conventional screw fasteners so as to enclose the normally open motor end of housing 26. Suitable seals (not shown) can permit the chamber within housing 26 to be filled with a lubricating oil, and the like, not shown, to facilitate movement of the various elements within housing 26. Bottom wall 34 is provided with an opening disposed centrally thereof, with a hollow, stepped hub 40 being disposed within the opening for receiving the adjacent end of the abutment 28. Resilient assembly 30 also includes a stem 42 which extends longitudinally substantially coaxial with shaft 14 and is slidably mounted in housing 26, and a spiral torsion spring 44 disposed within the hollow chamber of cup 32 and having an inner end 46 and an outer end 48. The latter end is affixed to side wall 36 of cup 32 in a conventional manner, such as by the illustrated screw fastener, with inner end 46 being connected to stem 42 for winding tight the spring upon rotation of cup 32 together with the housing 26 and pulley 24. Disposed within housing 26 at the juncture of the chamber portion thereof in which cup 32 is arranged and a smaller diameter portion connecting the chamber portion to pulley 24 is a nut 50 having internal screw threads 52 which selectively, threadingly engage with external threads 54 provided on a cylindrical portion 56 of stem 42 due to the relative rotation between pulley 24 and stem 42 as the latter is locked against rotation by abutment 28.

Figures 2, 3, 4, 6:
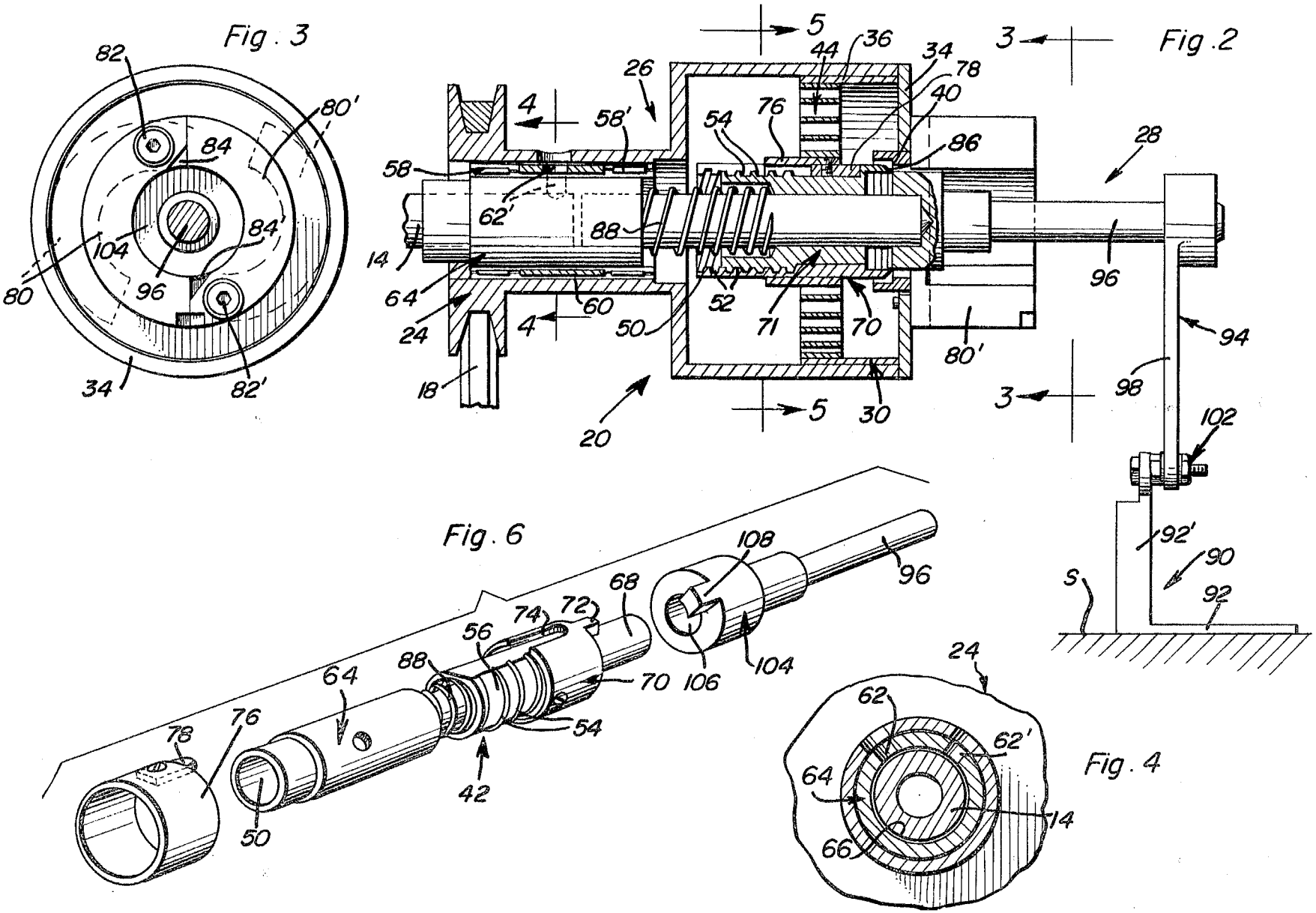
FIG. 2 is an enlarged, fragmentary, side elevational view, partly cut away and in vertical, longitudinal section, showing in greater detail the needle positioning attachment seen in FIG. 1.
FIG. 3 is a sectional view taken generally along the line 3—3 of FIG. 2, with some parts removed for clarity.
FIG. 4 is a fragmentary, sectional view taken generally along the line 4—4 of FIG. 2.
FIG. 6 is an exploded, perspective view showing a portion of the internal elements of the needle positioning attachment seen in FIGS. 1 through 5.

Disposed within the reduced diameter portion of housing 26 are a pair of bearings 58 and 58′ separated by a collar 60 releasably clamped to shaft 14 by suitable set screws which pass through holes provided in the reduced diameter portion of housing 26 and the collar 60, these holes being matched with one another as seen in FIG. 4, and into threaded bores 62 and 62′ provided in a coupler 64 so as to abut against the outward end of shaft 14 which itself is fitted into a socket 66 of coupler 64.

Stem 42 comprises a longitudinally extending element 68, preferably in the form of the illustrated rod, on which is disposed a hollow sleeve 70 including a spring seat 71 (FIG. 2) and a projection 72 extending toward abutment 28. A slot 74 is provided in sleeve 70 extending inwardly thereof from the edge spaced from that edge from which extends projection 72, and a bushing 76 having a key 78 which engages in slot 74 is advantageously provided so as to protect threads 54 from damage. Suitable screws can be used to secure sleeve 70 to element 68.

A pair of identical cams 80 and 80′ are mounted on the outwardly facing surface of bottom wall 34 of cup 32 as by the illustrated bolts 82 and 82′, respectively, for completing disengagement of projection 72 from abutment 28. Each of these cams 80 and 80′ is an elongated member having a through hole extending perpendicularly to the curve of the member and disposed ajacent one of the elongated ends thereof for receiving the respective bolt 82 and 82′, with cam surfaces 84 and 84′ being provided on the member adjacent the through hole for selectively engaging with the chamfered rim 86 of sleeve 70, the rim 86 forming the edge of sleeve 70 from which projection 72 extends, and forcing sleeve 70 against the bias of a helical coil compression spring 88 disposed between the spring seat 71 and the edge of coupler 64 disposed opposite sleeve 70 for assuring that projection 72 will be completely clear of abutment 28 when the spiral torsion spring 44 has been wound and stem 42 is threadingly connected to drive shaft 14 by coupler 64.

Stationary abutment 28 includes a weight in the form of an L-shaped bracket 90 comprising a pair of perpendicularly extending legs 92 and 92', leg 92 of which rests on a horizontal surface S and the like. A crank 94 is affixed to an axle 96 and includes an arm 98 which extends substantially vertically downwardly from a hub of crank 94 toward leg 92', and is provided with a slot 100 (FIG. 1) in which is disposed a fastener 102 that also engages an eye extension provided on leg 92' so as to adjustably connect arm 98 to leg 92' in a rigid manner. Axle 96 extends from crank 94 and terminates in a bowl 104 provided with a socket 106 arranged for receiving the outward end of element 68, and from which extends a lug 108 engageable with projection 72 to restrain stem 42 against rotation in the direction of rotation of pulley 24.

In operation, it will be appreciated that rotation of housing 26, due to rotation of pulley 24, will cause spiral torsion spring 44 to be wound tight relative to stem 42 as stem 42 is retained against rotation together with housing 26 by lug 108 of stationary abutment 28. Rotation of housing 26, however, will also rotate the nut 50 so as to thread stem 42 into nut 50 and couple same to shaft 14 of sewing machine 10. As stem 42 is being so threaded, the cams 80 and 80' will be swung outwardly due to rotation of cup 32 together with housing 26, so that the cam surfaces 84 and 84' will engage with the chamfered rim 86 of sleeve 70 and bias sleeve 70 against projection 72 of sleeve 70 completely out of engagement with lug 108 once stem 42 is completely threaded into nut 50. Now stem 42 and housing 26 will rotate as a unit and spring 44 will retain accumulated energy therein. That is, the spiral torsion spring will remain wound. Once motor 16 is deactivated and shaft 14 of sewing machine 10 stops rotating, however, spring 44 will cause stem 42 to unthread from nut 50, rotating housing 26 and therefore shaft 14 a predetermined amount in the process as spring 44 unwinds. By proper selection and adjustment of spring 44, shaft 14 can be rotated a predetermined amount in order to position the needle (not shown) of sewing machine 10 in a desired position for the start of the next sewing operation. Further, stem 42 will completely unthread from nut 50 and projection 72 of sleeve 70 will become reengaged with lug 108 of abutment 28 so as to permit the above cycle to repeat once sewing recommences.

When the motor 16 of the sewing machine 10 starts, the pulley 24 and the housing 26 of the needle positioner begin moving simultaneously. When this occurs, the main shaft 14 and the stem 42 remain static because 104 keeps it from moving. Since the stem 42 is static as the housing moves, the spiral torsion spring 44 gets wound. At the same time as the housing 26 moves the stem becomes disengaged from 104 as it becomes screwed into the threads on the housing. As this occurs, the main shaft 14, the stem 42 and the housing 26 begin moving together until the motor 16 of the sewing machine 10 stops. Then, the pulley 24 and housing 26 stop immediately as the sewing machine stops and the spiral torsion spring 44 will cause the stem 42 to rotate in the opposite direction so as to disengage the threads on the housing, causing projection 72 to engage 108, and making the needle stop at the preset position.

As can be readily understood from the above description and from the drawings, a needle positioning attachment according to the present invention permits a conventional sewing machine to be provided with a needle positioning capability in a simple, yet rugged and reliable manner, with installation of the attachment being achieved merely by removing the conventionally provided handwheel and associated pulley assembly from the machine and replacing same with the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a sewing machine comprising a head, a main drive shaft extending through the head and rotatably journaled thereon, a motor connected to the shaft for rotating same, and a needle positioning attachment, the improvement wherein the needle positioning attachment is connected to the shaft and arranged for accumulating energy from the rotation of the shaft for actuation when the shaft ceases rotation in order to turn the shaft a predetermined amount, said needle positioning attachment comprising, in combination:

(a) pulley means affixed to the shaft and connected to the motor for rotation thereby;

(b) a stationary abutment; and (c) resilient means connected to the pulley means and releasably engageable by the stationary abutment for being restrained against rotation in one direction thereof by the stationary abutment so as to permit the resilient means to accumulate energy by rotation of the pulley means relative to the resilient means, said resilient means including a cup affixed to the pulley means, a stem arranged extending through the cup and disposed substantially coaxial with the main drive shaft of the sewing machine, and a spiral torsion spring disposed within the cup, the spring having an inner end and an outer end, the latter being affixed to the cup and the inner end being connected to the stem for winding tight the spiral torsion spring as the cup, and pulley means to which the cup is affixed, rotate relative to the stem, a nut disposed in the pulley means and provided with internal screw threads, with external screw threads being provided on the stem at a portion thereof disposed adjacent the nut, the threads of the stem being engageable with the threads of the nut for advancing the stem axially relative to the pulley means as the stem is threaded into the nut and connected to the main drive shaft of the sewing machine by means of the pulley means for coupling the stem to the drive shaft.

2. An improvement as defined in claim 1, wherein the stem comprises a longitudinally extending element and a counterbored, hollow sleeve affixed to the element, with the pulley means including a coupler arranged for mounting the pulley means on the drive shaft of the sewing machine, with a compression spring being disposed partially within the counterbore of the sleeve and extending to and abutting the coupler for biasing the sleeve and element away from the coupler and into engagement with the stationary abutment for preventing rotation of the stem in the direction of rotation of the pulley means, and cam means mounted on the cup for engaging the sleeve on rotation of the pulley means and moving the sleeve and element against the bias of the compression spring and out of engagement with the stationary abutment.

3. An improvement as defined in claim 2, wherein the cup has a substantially planar bottom wall, with the cam means including an elongated member pivotally mounted on a surface of the bottom wall of the cup which surface is spaced from the spiral torsion spring and is arranged for swinging about substantially the elongated length of the member, the elongated member being provided with a cam surface arranged for biasingly engaging the sleeve of the stem when the member is swung outwardly by centrifugal force created by rotation of the cup together with the pulley means and moving the sleeve against the bias of the compression spring and holding the sleeve out of engagement with the stationary abutment.

4. A needle positioning attachment for a sewing machine, comprising, in combination:

(a) pulley means mountable to the main drive shaft of a sewing machine and to a drive motor for the sewing machine for rotation by the motor and with the shaft;

(b) a stationary abutment; and (c) resilient means connected to the pulley means and releasably engageable by the stationary abutment for being restrained against rotation in the direction of rotation of the pulley means and accumulating energy imparted to the resilient means by rotation of the pulley means for turning the drive shaft a predetermined amount when the motor is deactiyated and ceases to rotate the drive shaft of the sewing machine, said resilient means including a cup affixed to the pulley means, a stem arranged extending through the cup and disposed substantially coaxial with the main drive shaft of the sewing machine, and a spiral torsion spring disposed within the cup, the spring having an inner end and an outer end, the latter being affixed to the cup and the inner and being connected to the stem for winding tight the spiral torsion spring as the cup, and pulley means to which the cup is affixed, rotate relative to the stem, a nut disposed in the pulley means and provided with internal screw threads, with external screw threads being provided on the stem at a portion thereof disposed adjacent the nut, the threads of the stem being engageable with the threads of the nut for advancing the stem axially relative to the pulley means as the stem is threaded into the nut and connected to the main drive shaft of the sewing machine by means of the pulley means for coupling the stem to the drive shaft.

5. An improvement as defined in claim 4, wherein the stem comprises a longitudinally extending element and a counterbored, hollow sleeve affixed to the element, with the pulley means including a coupler arranged for mounting the pulley means on the drive shaft of the sewing machine, with a compression spring being disposed partially within the counterbore of the sleeve and extending to and abutting the coupler for biasing the sleeve and element away from the coupler and into engagement with the stationary abutment for preventing rotation of the stem in the direction of rotation of the pulley means, and cam means mounted on the cup for engaging the sleeve on rotation of the pulley means and moving the sleeve and element against the bias of the compression spring and out of engagement with the stationary abutment.

6. An improvement as defined in claim 5, wherein the cup has a substantially planar bottom wall, with the cam means including an elongated member pivotally mounted on a surface of the bottom wall of the cup which surface is spaced from the spiral torsion spring and is arranged for swinging about substantially the elongated length of the member, the elongated member being provided with a cam surface arranged for biasingly engaging the sleeve of the stem when the member is swung outwardly by centrifugal force created by rotation of the cup together with the pulley means and moving the sleeve against the bias of the compression spring and holding the sleeve out of engagement with the stationary abutment.

7. A structure as defined in claim 4, wherein the pulley means includes a pulley affixable to the main drive shaft of a sewing machine in place of a conventional pulley and handle arrangement removed from the sewing machine, and a housing extending from the pulley, with the resilient means being disposed within the housing, the housing being sealed, hollow unit filled with a lubricating fluid.

* * * * *